United States Patent [19]

Allbright

[11] 4,351,988

[45] Sep. 28, 1982

[54] KEYBOARD SWITCH ASSEMBLY

[75] Inventor: Forrest E. Allbright, Centerville, Ohio

[73] Assignee: NCR Corporation, Dayton, Ohio

[21] Appl. No.: 213,974

[22] Filed: Dec. 8, 1980

[51] Int. Cl.[3] ..... H01H 13/70

[52] U.S. Cl. ..... 200/5 A; 200/159 B; 200/329; 200/340; 235/145 R

[58] Field of Search ..... 200/1 R, 5 R, 5 A, 159 B, 200/67 D, 67 DA, 67 DB, 314, 329, 340; 235/145 R

[56] References Cited

U.S. PATENT DOCUMENTS

| | | | |
|---|---|---|---|
| 3,489,342 | 1/1970 | Anderson | 235/145 |
| 3,612,802 | 10/1971 | Beadle et al. | 200/329 |
| 3,668,356 | 6/1972 | Kekas | 200/340 X |
| 3,707,609 | 12/1972 | Dapot et al. | 200/5 R |
| 3,800,104 | 3/1974 | Lien et al. | 200/5 A |
| 3,823,309 | 7/1974 | Caruso | 235/145 R |
| 3,839,785 | 10/1974 | Boulanger | 29/622 |
| 4,029,916 | 6/1977 | Chu | 200/340 X |
| 4,032,729 | 6/1977 | Koistinen | 200/5 A |
| 4,055,734 | 10/1977 | Hayden | 200/5 A |
| 4,066,860 | 1/1978 | Kawasaki | 200/340 X |
| 4,092,527 | 5/1978 | Luecke | 364/709 |
| 4,096,364 | 6/1978 | Lynn et al. | 200/5 A |
| 4,127,752 | 11/1978 | Lowthorp | 200/340 X |
| 4,160,886 | 7/1979 | Wright et al. | 200/5 A |

FOREIGN PATENT DOCUMENTS 2459464 6/1975 Fed. Rep. of Germany .

OTHER PUBLICATIONS

IBM Tech. Disc. Bull.; J. L. Yarborough, "Nonteasable Switch Actuator", vol. 16, No. 5, pp. 1520, 1521; Oct. 1973.

*Primary Examiner*—James R. Scott

*Attorney, Agent, or Firm*—J. T. Cavender; Albert L. Sessler, Jr.

[57] ABSTRACT

A keyboard assembly comprises a base, a plurality of pressure-operated switches mounted on said base, a keyboard comprising support means overlying the switches and having a plurality of key locations formed therewith, each including a key hinged at one side to the support means and disposed in operative relation to one of the switches, the support means defining a first aperture in each key location to permit movement of the key therethrough, each of the keys including a cantilever switch actuator which is initially formed in a first position on one side of the support means and then rotated so that it extends beneath said key from a toggle hinge on one side thereof to a second aperture in each key location on an opposite side of said key, said actuator being positioned to engage the corresponding switch when the key is depressed, an enlarged end portion of said switch actuating means being received in said second aperture, and coacting therewith during key depressing movement, said switch actuating means being retained in the rotated position beneath its key by said toggle hinge.

14 Claims, 8 Drawing Figures

KEYBOARD SWITCH ASSEMBLY

BACKGROUND OF THE INVENTION

The present invention relates to keyboards, particularly to keyboards in which the keys are integrally hinged to a supporting element.

A keyboard for the entry of information into a utilizing device such as a typewriter, or calculator or a data processing terminal normally includes a plurality of keys associated with a corresponding plurality of switches. Depression of a key results in operation of its corresponding switch, with the consequent input of information into the utilizing device.

In a number of well-known keyboard arrangements, the keys of the keyboard are formed integrally with a supporting element and are hinged thereto at one side. This simplifies manufacture and assembly. Associated with each key in such arrangements is an actuating means which engages the associated switch and operates it when the key is depressed. These actuating means may take various forms in order to attempt to achieve optimum design in providing a tactile "feel" to tell the operator that the key has been sufficiently operated, as well as providing reliability in switch actuation, flexibility and key overthrow cushioning.

SUMMARY OF THE INVENTION

The present invention is directed to a keyboard which includes an actuating means for each key which is configured to engage the corresponding switch during each key actuation in a reliable manner, which is formed integrally with each key and the associated support element, and which may be rotated from the position in which it is formed to an operative position beneath its associated key, in which it performs its switch-actuating function.

In accordance with one embodiment of the present invention, a keyboard assembly comprises base means; switching assembly means disposed on said base means and including a plurality of switching means; keyboard means operatively associated with the base means overlying and adjacent to the switching assembly means, having a plurality of keys each disposed in operative relation to one of the switching means; said keyboard means including support means to which each key is integrally hinged, said support means being apertured to permit movement of each key therethrough; each of said keys including a switch actuating means of cantilever construction extending beneath said key from one side thereof to an opposite side thereof and positioned to engage the corresponding switching means when said key is depressed.

It is accordingly an object of the present invention to provide a novel and efficient keyboard assembly.

Another object is to provide a keyboard assembly having keys which are formed integrally with a supporting element and also having a switch actuating means formed integrally with each key and subsequently rotated into an operative position beneath its key.

Another object is to provide a keyboard assembly having keys which include flexible switch actuating means.

With these and other objects, which will become apparent from the following description, in view, the invention includes certain novel features and combinations of parts, a plurality of forms or embodiments of which are hereinafter described with reference to the drawings which accompany and form a part of this specification.

DETAILED DESCRIPTION OF THE INVENTION

Figure 3:
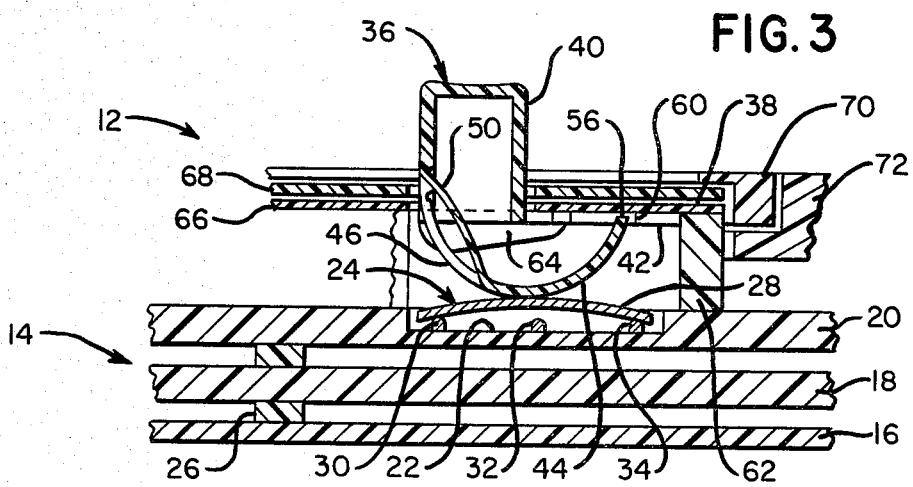
FIG. 3 is a sectional view taken along line 3—3 of FIG. 5, of a keyboard assembly.
Figure 5:
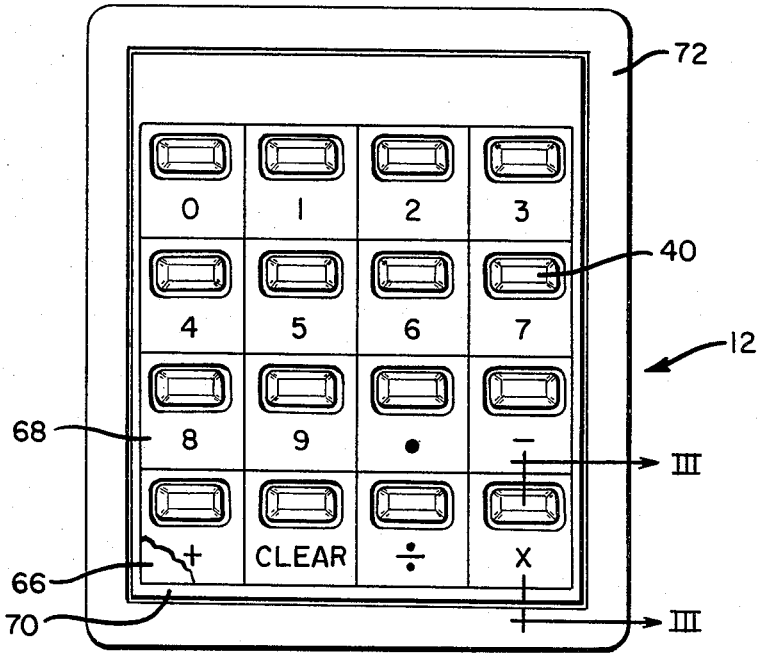
FIG. 5 is a plan view of a keyboard.

Referring now particularly to FIGS. 3 and 5 of the drawings, there is shown a keyboard designated as a whole by the reference character 12. The base 14 of the keyboard may typically include a printed circuit board 16 which provides an interface between the keyboard 12 and a utilizing device (not shown), a plate 18 which may provide means for mounting the keyboard to the utilizing device, and a switch plate 20 provided with a plurality of recesses 22 in which may be mounted individual switches 24 associated with corresponding keys of the keyboard. Any suitable fastening means 26, such as screws or rivets, may be employed to secure the elements 18, 20 and 22 together in operative relation.

Each switch 24 may be of the well-known "bubble" type, such as is disclosed in U.S. Pat. No. 3,707,609. In such a switch, a resilient diaphragm 28 functions as an electrical conductor, bridging contacts 30, 32 and 34, when depressed. Contact 32 may be connected to one circuit path, and contacts 30 and 34 to another. These contacts may, if desired, take the form of electrically conductive staples secured in the plate 20. Application of sufficient force to the diaphragm 28 by a switch actuator will cause it to change configuration from the convex, as viewed in FIG. 3, with "snapping" movement, to a generally flat configuration, thus bridging the contacts 30, 32, 34. Removal of pressure from the diaphragm causes it to spring back to the convex configuration in which it is shown in FIG. 3. The spring characteristics of the material of the diaphragm may be selected to provide a desired tactile "feel" for depression of a key corresponding to the switch, to inform the operator of the keyboard that the switch has been depressed to the necessary extent to bridge the contacts 30, 32, 34.

In the embodiment of FIGS. 1–4 inclusive, each key 36 of the keyboard 12 is formed integrally with a supporting sheet 38, and is located in operative relation to a corresponding switch 24. The key 36 includes a key body 40, a pair of "living" hinges 42, and a switch actuator 44. The actuator 44 is formed integrally with the key body 40, and the hinges 42 are formed integrally with both the key body 40 and the supporting sheet 38. The keys 36 and sheet 38 may be formed of a suitable plastic material having good hinging and spring characteristics, such as polypropylene, manufactured by Eastman Chemical Products, Inc.

Figure 1:
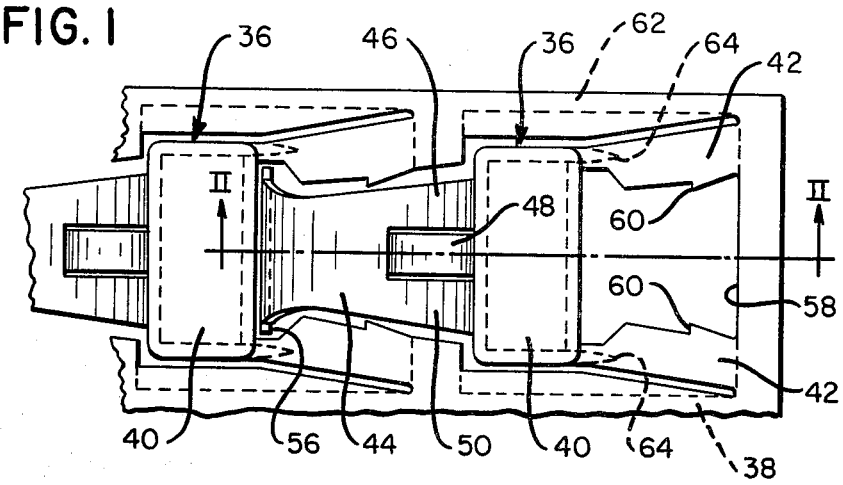
FIG. 1 is a fragmentary plan view of a first embodiment of the key array of the present invention.
Figure 2:
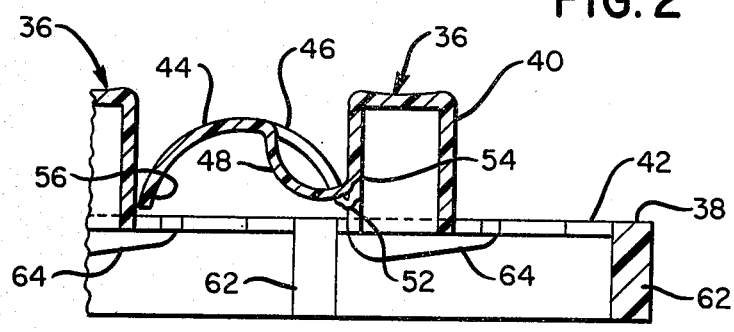
FIG. 2 is a fragmentary sectional view taken along line 2—2 of FIG. 1.

The actuator 44 is of generally semi-circular configuration, and is formed in the position in which it is shown in FIGS. 1 and 2. The connection of the actuator 44 to the key body 40 includes three "living" hinge elements 46, 48, 50.

This hinge enables the actuator 44 to be rotated approximately 180 degrees from the position in which it is shown in FIGS. 1 and 2 to the position below the key body 40 in which it is shown in FIG. 3, in which said actuator is positioned in operative relation to the diaphragm 28 of the switch 24. The hinge elements 46, 48, 50 form a toggle linkage, with the toggle point 52 of the elements 46 and 50 positioned below the toggle point 54 of the element 48. This toggle linkage is effective to retain the actuator 44 either in the position in which it is shown in FIG. 2 or in the position in which it is shown in FIG. 3.

Figure 4:
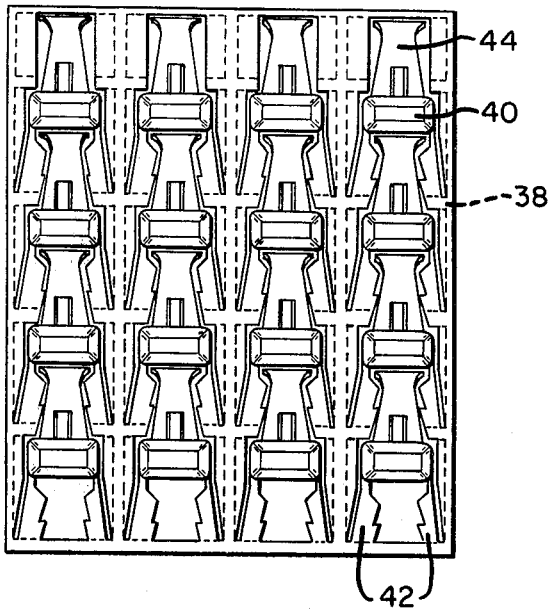
FIG. 4 is a plan view of said first embodiment of a key array for a keyboard.

The free end 56 of the actuator 44 is directed, during movement of the actuator into operative position, into an aperture 58 formed between the hinge 42, within which the actuator 44 of an adjacent key is initially located when the keyboard is formed, and before rotation of the actuator into the position of FIG. 3. Coaction of the end 56 of the actuator 44 with projections 60 formed at the edges of the aperture 58 serves to limit movement of the free end 56 of the actuator 44 when the key 36 is depressed. This rotation of the actuators 44 for all of the keys 36 formed with a sheet 38 to form a keyboard unit such as is shown in FIG. 4 takes place before the said keyboard unit is assembled with the other elements to form the completed keyboards shown in FIGS. 3 and 5.

Formed integral with the sheet 38 are a plurality of reinforcing ribs 62 which serve to increase the rigidity of said sheet, and which also perform a spacing function to provide a desired distance between the sheet 38 and the switch plate 20 in which the switches 24 are mounted. Formed integral with the key bodies 40 are a plurality of stop members 64 which are effective to limit the total permitted downward movement of a depressed key 36.

As shown in FIGS. 3 and 5, a key position legend mask 66 and a transparent protective shield 68 overlie the sheet 38 and are held in place by a bezel 70 mounted in a housing 72 which may include the keyboard, together with the remaining associated structure, including the circuit board 16, the mounting plate 18 and the switch plate 20.

As may be seen in FIG. 3, when a load is applied to a key 36, causing it to be displaced downward, the hinges 42 are deflected arcuately, distributing the load through their lengths and storing tension to restore the key 36 to its normal home position when the load is removed. The displacement of the key 36 under load will cause the switch actuator 44 to engage the diaphragm 28 of the switch 24, forcing it downward against the contacts 30, 32, 34. The diaphragm 28 will snap and engage the center contact 32, completing the electrical circuit through the switch 24. The snap action of the diaphragm provides a feedback to the operator which may be both felt and heard.

The force on the key 36 is transmitted through the hinge 46, 48, 50 to the actuator 44, and causes the actuator to be deflected when it engages the diaphragm 28. Further downward displacement of the key 36 will cause the free end 56 of the actuator 44 to be extended into the aperture 58 between the hinges 42, until the end 56 engages the projections 60 on either side of the aperture 58. Any further deflection of the actuator 44 will provide a cushioning effect to resist further overtravel of the key 36. Tension stored in the actuator 44 from this action will assist in restoring the key 36 to its normal home position when the load is removed from it.

Figure 6:
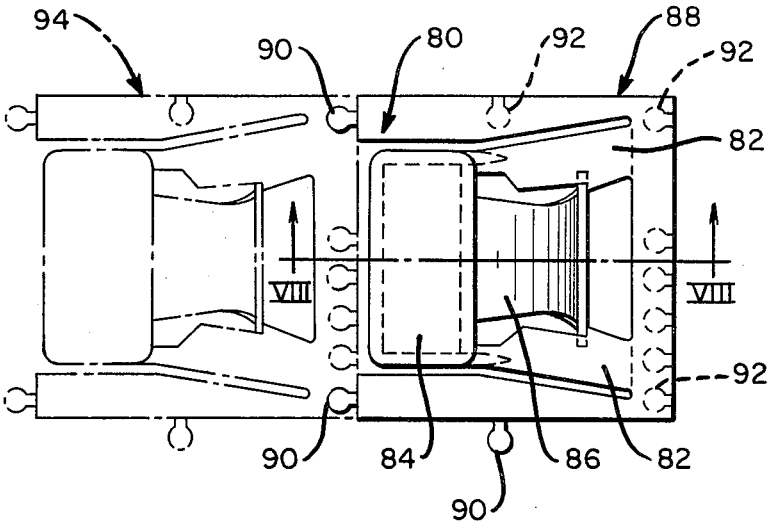
FIG. 6 is a plan view of a second embodiment of the invention, in which individual key modules are provided, which can be assembled to form a key array of the desired size.
Figure 7:
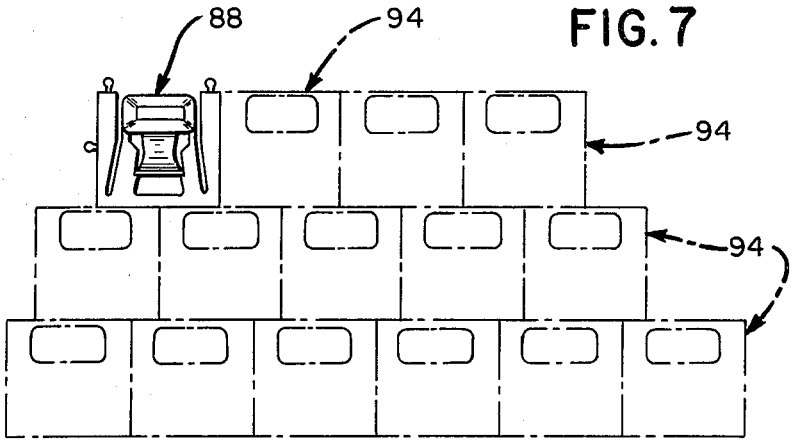
FIG. 7 is a view similar to FIG. 6, showing other arrangements in which the key module of FIG. 6 can be assembled to form a key array.
Figure 8:
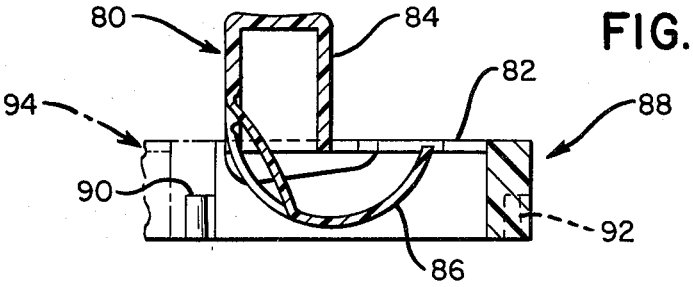
FIG. 8 is a sectional view, taken along line 8—8 of FIG. 6.

Shown in FIGS. 6, 7 and 8 are three views of a second embodiment of the invention. This embodiment differs from the embodiment of FIGS. 1, 3 and 4 in that each key 80, including hinges 82, key body 84 and actuator 86, is formed in a separate module 88, rather than having all of the keys of a keyboard formed integrally with a single supporting sheet. The actuator 86 of each module is rotated into its operative position before assembly of the modules. Projections, or tenons, 90 and mating recesses, or mortises, 92 may be employed to secure a plurality of modules together in assembled relationship to form a keyboard of whatever size or arrangement is needed. A second module 94 is shown in phantom to illustrate the manner in which a plurality of modules may be assembled in aligned relationship. It will be seen that a plurality of additional modules may also be added above, below and to the right of the module 88, as viewed in FIG. 6. In FIG. 7, the modules are shown assembled in an offset relationship, in which a different pairing of mortises and tenons is employed. It will be noted in FIG. 7 that the middle row of modules is offset from the topmost row by approximately one-half of a module width, and that the lower row is offset from the middle row by approximately one-fourth of a module width. The offset arrangement is of particular utility in a typewriter keyboard, which is customarily configured in such a manner.

While the forms of the invention shown and described herein are admirably adapted to fulfill the objects primarily stated, it is to be understood that it is not intended to confine the invention to the forms or embodiments disclosed herein, for it is susceptible of embodiment in various other forms within the scope of the appended claims.

I claim:

1. A keyboard assembly comprising:

base means;

switching assembly means disposed on said base means and including a plurality of switching means;

keyboard means operatively associated with the base means overlying and adjacent to the switching assembly means, having a plurality of keys each disposed in operative relation to one of the switching means;

said keyboard means including support means to which each key is integrally hinged, said support means being apertured to permit movement of each key therethrough;

each of said keys including a switch actuating means of cantilever configuration extending beneath said key from one side thereof to an opposite side thereof and positioned to engage the corresponding switching means when said key is depressed.

2. The keyboard assembly of claim 1 in which said support means is provided with an aperture adjacent said opposite side of each key, and in which each of said switch actuating means is provided with a free end portion which coacts with said aperture during key depressing movement.

3. The keyboard assembly of claim 1 in which said switch actuating means is provided with a toggle hinge integral with the key at said one side thereof for retaining said switch actuating means in position beneath said key.

4. The keyboard assembly of claim 2 in which the aperture adjacent the opposite side of each of said keys has a shape substantially similar to the shape of said switch actuating means.

5. The keyboard assembly of claim 2 in which the free end portion of each switch actuating means is enlarged to limit the movement of the switch actuating means in one direction with respect to said aperture during key depressing movement.

6. The keyboard assembly of claim 1 in which the switch actuating means is of arcuate configuration.

7. The keyboard assembly of claim 1 in which said support means is a single integral element for the entire keyboard means.

8. The keyboard assembly of claim 1, also including stop means associated with each key to limit the travel thereof.

9. The keyboard assembly of claim 1 in which a separate support means is associated with each key, and also including means for securing individual support means together to constitute the keyboard means.

10. The keyboard assembly of claim 9 in which the individual support means are secured together in aligned relationship.

11. The keyboard assembly of claim 9 in which the individual support means are secured together in offset relationship.

12. A keyboard assembly comprising:

base means;

switching assembly means disposed on said base means and including a plurality of pressure-operated switching means;

keyboard means operatively associated with the base means overlying and adjacent to the switching assembly means, having a plurality of key locations, each including a key disposed in operative relation to one of the switching means;

said keyboard means including a planar support element to which each key is integrally hinged, said support element including a first aperture in each key location to permit movement of the key therethrough;

each of said keys including a switch actuating means extending beneath said key from a toggle hinge on one side thereof to a second aperture in each key location on an opposite side of said key and positioned to engage the corresponding switching means when said key is depressed, an enlarged end portion of said switch actuating means being received in said second aperture, and coacting therewith during key depressing movement, said switch actuating means being retained in its position beneath its key by said toggle hinge.

13. A keyboard comprising:

a support element having a plurality of key locations, each including a key integrally hinged to the support element, said support element including a first aperture in each key location to permit movement of the key therethrough;

each of said keys including a switch actuating means extending beneath said key from a toggle hinge on one side thereof to a second aperture in each key location on an opposite side of said key, an enlarged end portion of said switch actuating means being received in said second aperture, and coacting therewith during key depressing movement, said switch actuating means being retained in its position beneath its key by said toggle hinge.

14. A keyboard comprising:

a plurality of keys;

a sheet of plastic material for supporting said keys, providing a hinge connection at one side of each key;

a plurality of first apertures in said sheet partially surrounding each of said keys and freeing said keys for movement about their hinge connections relative to said sheet;

a plurality of switch actuating means connected to each key by a toggle hinge at an opposite side of each said key from its hinge connection to said sheet;

a plurality of second apertures in said sheet partially surrounding each of said switch actuating means and freeing said switch actuating means for movement relative to said sheet;

said first and second apertures being arranged on said sheet so that the second aperture associated with a given key is located in proximity to the hinge connection for an adjacent key, whereby the switch actuating means for the adjacent key may be rotated therebeneath, past the toggle point of its toggle hinge, so that its free end extends into the second aperture associated with the given key.

* * * * *